US005183105A

United States Patent [19]

Adams

[11] Patent Number: 5,183,105

[45] Date of Patent: Feb. 2, 1993

[54] OPPOSED CANTED EVAPORATOR

[75] Inventor: Michael B. Adams, Sylvania, Ohio

[73] Assignee: Brazeway, Incorporated, Adrian, Mich.

[21] Appl. No.: 726,992

[22] Filed: Jul. 8, 1991

[51] Int. Cl.[5] ..... F28D 1/47; F25B 39/02

[52] U.S. Cl. ..... 165/140; 165/151; 62/515

[58] Field of Search ..... 165/150, 151, 172; 62/515, 524, 526, 525

[56] References Cited

U.S. PATENT DOCUMENTS

| | | | |
|---|---|---|---|
| 1,991,176 | 2/1935 | Rutishauser | 165/150 |
| 2,220,595 | 11/1940 | Andersen | 62/525 |
| 2,322,341 | 6/1943 | Booth | 165/179 |
| 2,424,287 | 7/1947 | Schlumbohm | 165/122 |
| 2,437,452 | 3/1948 | Baird | 165/135 |
| 2,874,555 | 2/1959 | Disinger et al. | 62/525 |
| 3,780,799 | 12/1973 | Pasternak | 165/151 |
| 4,175,617 | 11/1979 | Hahn et al. | 165/172 |
| 4,446,915 | 5/1984 | Welch et al. | 165/144 |
| 4,527,624 | 7/1985 | Nishida et al. | 62/515 |
| 4,580,623 | 4/1986 | Smitte et al. | 165/150 |
| 4,592,420 | 6/1986 | Hughes | 165/151 |
| 4,690,209 | 9/1987 | Martin | 165/150 |

FOREIGN PATENT DOCUMENTS

| | | | |
|---|---|---|---|
| 739915 | 1/1933 | France | 165/172 |
| 1128093 | 11/1983 | U.S.S.R. | 165/151 |
| 591602 | 8/1947 | United Kingdom | 165/172 |

*Primary Examiner*—John Rivell
*Assistant Examiner*—L. R. Leo
*Attorney, Agent, or Firm*—Krass & Young

[57] ABSTRACT

A heat exchanger formed of a continuous serpentine tube having parallel tube runs interconnected by reverse bends. The exchanger is folded so as to form the generally bi-planar configuration resulting in two rows of tube wherein the tubes of the tube rows are canted in opposite directions. Canting the tubes in opposite directions permits a freer flow of air over the tubes, thus increasing the efficiency of the evaporator while lowering the operating costs.

6 Claims, 2 Drawing Sheets

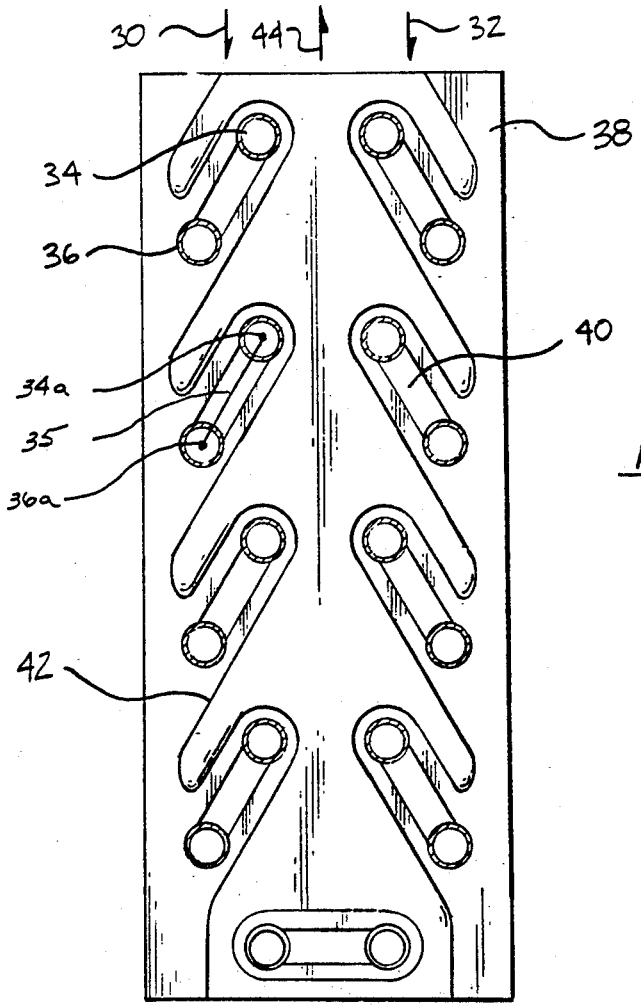
FIG - 4
FIG - 3
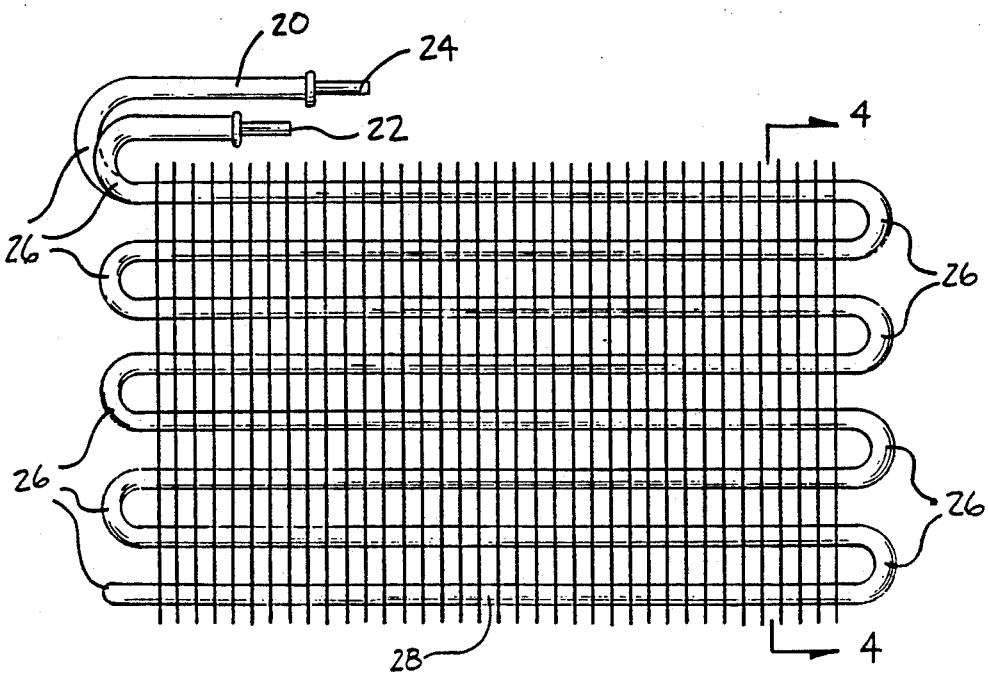

OPPOSED CANTED EVAPORATOR

FIELD OF THE INVENTION

This invention relates to heat exchangers and more particularly to an evaporator apparatus for use in a household refrigeration system.

BACKGROUND OF THE INVENTION

A household refrigeration system utilizes a heat exchanger comprised of a plurality of parallel tubes having a plurality of perpendicular fins attached thereto to serve as an evaporator. A heat absorbing fluid is forced through a capillary tube into the evaporator tubes. Since the fluid inside the evaporator is now at a lower temperature and pressure, the fluid evaporates and removes heat from the air passing adjacent the tubes of the evaporator, thus cooling the air. The fins attached to the tube increase the effective heat absorbing area over which the air flow is directed, thus increasing the cooling efficiency of the evaporator. A small motor driven fan is utilized to draw air over the heat absorbing area of the evaporator and discharge the cooled air into the interior of the refrigerator.

Several attempts have been made to increase the cooling efficiency of the evaporator by varying the arrangement of the tube pattern and fin shape. U.S. Pat. No. 4,580,623 discloses a heat exchanger having parallel rows of serpentine tube coils slanting in the same direction and using ultra thin fins having a pattern embossed thereon to induce turbulence in the air flow over the evaporator. However, the refrigeration industry is currently requiring a wider evaporator to increase the face area of the evaporator met by the air flow to reduce the effects of frost growth and thereby increase the cooling efficiency of the refrigerator system. Therefore, use of an evaporator wherein the tubes are sloping in the same direction, as described in the above-mentioned patent, requires an additional row of tubes to obtain the necessary evaporator width. Adding an additional row of tubes to the evaporator increases the amount of material necessary to manufacture the evaporator, thus increasing cost. The additional row of tubes can also lead to excessive air side pressure drops.

It is the object of the present invention to provide an evaporator which permits a freer flow of air, thereby reducing the pressure needed to move a required amount of air through the evaporator coil and correspondingly reducing the power consumed by the evaporator fan.

An additional object of the present invention is to reduce the length of tubing in the evaporator. This is important not only from a material (and cost) reduction standpoint, but will reduce internal pressure drop when making major system modifications necessitated by UNEP and government mandated phasing out of existing CFC refrigerants. It is believed that to optimally use the replacement HFC's a tube diameter of 5/16" should be used instead of the more widely used ⅜". Simply replacing the ⅜" tube with 5/16" tube in the same configuration will cause an increase in refrigerant side pressure drop. This increased pressure drop will force the compressor to work harder and therefor consume more energy.

The aforementioned potential reductions in energy consumption are of great interest to the appliance industry as a whole because of the strict energy regulations that go into effeot in 1993.

SUMMARY OF THE INVENTION

The present invention is accordingly directed to an approved heat exchanger for use as an evaporator in a refrigeration system. The evaporator is formed of a continuous tube having a plurality of reverse bends forming a plurality of parallel tube rows arranged in sets of two as determined by each of the respective reverse bends. The tube is folded in adjacent rows of parallel tube runs to form a tube bundle. The tubes in the tube bundle are arranged such that when viewed in cross section, lines drawn between the centers of the sets of two tubes form a herringbone pattern.

It will be see that arranging the tubes in this manner permits a freer flow of air through the evaporator reducing the pressure needed to move the air through the evaporator coil, thus reducing the power required by the fan. Additionally, the foregoing tube arrangement enables the use of a shorter tube length which reduces manufacturing costs.

These and other advantages of the invention will become apparent upon reference to the following Drawing and Detailed Description of the Illustrative Embodiment.

BRIEF DESCRIPTION OF THE DRAWING

FIG. 3 is an elevational view of the evaporator shown in FIG. 1; and

FIG. 4 is a sectional view taken along lines 4—4 of FIG. 3.

DETAILED DESCRIPTION OF THE ILLUSTRATED EMBODIMENT

Figure 1:
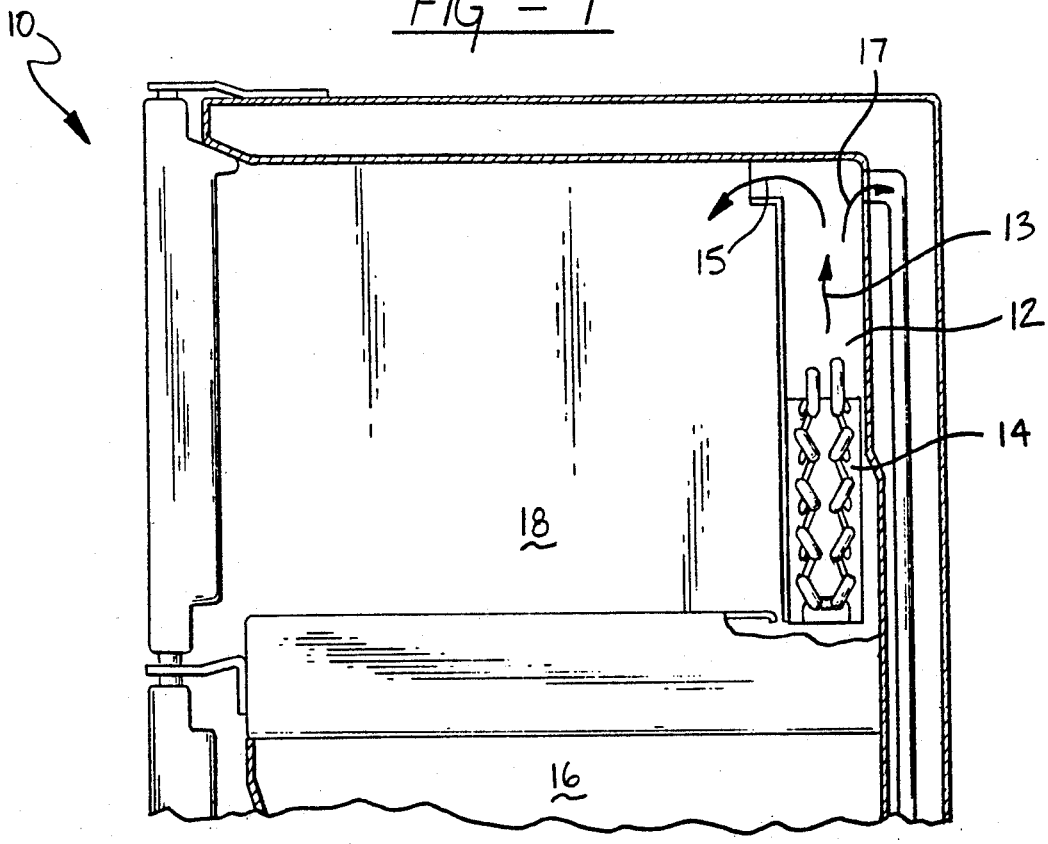
FIG. 1 is a cross-sectional view of a refrigerator cabinet showing an evaporator according to the illustrated embodiment disposed behind the rear wall of the freezer compartment.

In FIG. 1 a household refrigeration system is shown comprising a refrigerator 10 having a spaced apart wall section forming a passageway 12. An evaporator 14 in accordance with the invention is placed in the passageway 12 and is used to cool the air drawn in the direction indicated by the arrow 13, over the evaporator 14 and discharged 15,17 into both the refrigerator 16 and freezer 18 cabinets by a fan (not shown). The evaporator 14, when used in a household appliance such as a refrigerator, is placed in a high humidity environment wherein cooling the air causes moisture to condense on the evaporator 14 resulting in the formation of frost and ice. As frost and ice begins to build up on the evaporator 14, the air flow over the evaporator is reduced causing an air side pressure drop and a decrease in the cooling efficiency of the device; i.e., reducing the air flow over the evaporator 14 reduces the amount of cool air discharged into the freezer 18 and refrigerator 16 compartments of the refrigerator 10. In an attempt to keep the refrigerator at the desired temperature level, the system works harder; i.e., the compressor (not shown) runs almost continuously to provide a greater supply of heat absorbing fluid to the evaporator 14 in an attempt to provide additional cool air to the refrigerator 16 and freezer 18 compartments. To remove the ice build up and provide for a freer flow of air through the evaporator 14 a heater element (not shown) is used on a periodic basis to melt the frost and ice. The resultant water is collected on a collecting pan and removed through a drain (not shown) from the refrigerator. It will be seen that the freer the air flow over the evaporator 14 the more efficient the system. Increasing the number of tubes used in the evaporator to provide additional cooling surfaces also reduces the air flow over the evaporator and correspondingly reduces the efficiency.

Figure 2:
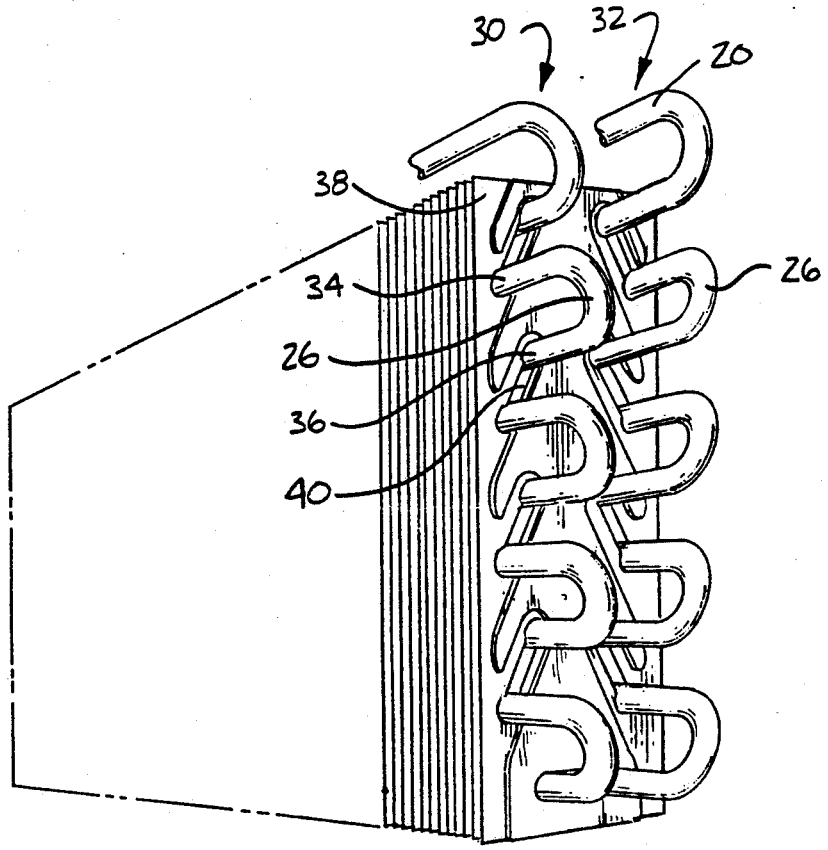
FIG. 2 is a perspective view of an evaporator according to the illustrated embodiment of the invention.

Referring now to FIGS. 2–4, the evaporator 14 of the illustrated embodiment comprises a continuous tube 20 having both inlet 22 and outlet 24 ends. The tube is formed in a serpentine configuration by a plurality of reverse bends 26 and parallel tubes runs 28. The tube 20 is folded into an essentially bi-planar configuration resulting in two adjacent rows of tubes 30, 32 see FIG. 4. The rows 30,32 of tubes are made up of sets of two parallel tubes 34,36 with the exit of each set connected to the entrance of the next successive set in the respective row by a respective reverse bend 26. The sets of parallel tubes in each row 30,32 are oppositely canted; i.e., sloped in opposite directions relative to the longitudinal axis of the tube row 30,32. The tubes are canted such in such a manner that lines 35 connecting the centers **34*a*,34*b* of the parallel, tubes 34,36 in each of the sets of two parallel tubes form a herringbone pattern. As shown in FIGS. 2–4** the evaporator comprises two oppositely canted rows of sets of two tubes, each row divided into two columns of vertically aligned tubes.

Fins 38 are secured on the tubes by inserting the tubes in oppositely canted slots 40 on the fins. The overall length of the slot 40 is slightly less than the overall outer dimension of the set of two tubes. Since the overall length of the slot is slightly less than the overall outer dimension of the set of two tubes, the tube sets are press fit into the slots 40 to ensure metal to metal contact which enhances heat conduction between the tube walls and the fins. The fins 38 include an embossed portion 42 adjacent the slots 40 to increase the structural rigidity of the fin 38. The fins are evenly spaced on the tube and when used in household refrigeration units are normally spaced three-to-five fins per inch of tube.

According to the present invention an evaporator having 5/16" diameter tubing used in combination with a 3" wide by 7" high fin would have two vertical rows of opposing canted tubes, the rows opposingly canted at a 42° angle. When using ⅜" diameter tubing and a 3" wide by 7" high fin the vertical rows of tubing are opposingly canted at a 30° angle. The height of the fin when used with either size tubing may be varied from 6 to 18 inches.

It will be seen that as air is drawn over the evaporator 14 in the direction shown by arrow 44 (see FIG. 4), the air engages four rows of vertically aligned parallel tubes thereby increasing the efficiency of the evaporator 14 over prior art evaporators having two rows of vertically aligned tubes. In order to obtain the necessary evaporator width, prior art evaporators having vertically aligned tubes or tubes slanted in the same direction require the use of three rows of tubes. The use of three rows of tubes results in increased tube length and an increased air and refrigerant pressure drops and correspondingly a decrease in the efficiency of the evaporator. The present invention by canting or sloping the tube rows in opposite directions enables the manufacture of a wider evaporator comprising two rows of oppositely sloping tubes. Accordingly the invention results in lower manufacturing costs and a lower air side and refrigerant side pressure drop which enables the use of a smaller fan and compressor motor, thus decreasing operating costs and noise. Further, the use of two rows of tubes allows both the inlet and the outlet of the evaporator to be at the top enabling the evaporator to act as an accumulator, thus eliminating the use of an auxiliary accumulator from the system.

Canting the rows in opposite directions provides a freer flow of air through the evaporator and reduces the pressure needed to move a required amount of air through the evaporator coil. Thus it is apparent that there has been provided, in accordance with the invention, a heat exchanger that fully satisfies the objects, aims and advantages set forth above. While the invention has been described in conjunction with the illustrated embodiment thereof, it is evident that many alternatives, modifications and variations will be apparent to those skilled in the art in light of the foregoing description. Accordingly, it is intended to embrace all such alternatives, modifications and variations.

I claim:

1. A heat exchanger comprised of a continuous tube for conveying a first fluid wherein the tube to exchange heat with a second fluid surrounding the tube, said tube having a plurality of reverse bends forming a plurality of parallel tube runs arranged in sets of two as determined by the respective reverse bends, each of the sets of two defining an entrance and an exit to the set, said tube folded into a tube bundle comprising two adjacent parallel spaced rows with each row comprising a plurality of successive sets of two runs with the exit of each set connected by a reverse bend to the entrance to the next successive set in the row, the tube runs in said bundle being arranged such that, when viewed in cross section, lines drawn between the centers of the tubes in each of the sets of two of one of said rows coact with lines drawn between the centers of the tubes in each of the sets of two in the other of said rows to form a herringbone pattern.

2. A heat exchanger according to claim 1 including a plurality of essentially parallel spaced-apart fine extending perpendicular to said tubes and having slots therein through which said tubes extend arranged in a herringbone pattern to match the herringbone pattern of said tube bundle.

3. A heat exchanger according to claim 2 wherein the slots of said fine have a length less than the overall outer dimension of the sets of two tubes, so that the reverse bend of the tube may be inserted in the slot and the tubes are press fit against the ends of the slots.

4. A heat exchanger comprised of a continuous tube for conveying a first fluid within the tube, to exchange heat with a second fluid surrounding the tube, the tube having a plurality of reversed bends forming a plurality of parallel tube runs arranged in sets of two as determined by the respective reverse bends, each of the sets of two defining an entrance and an exit to the set, said tube folded into a tube bundle comprising two adjacent parallel rows spaced on either side of a central plane with each row comprising a plurality of successive sets of tube runs with the exit of each set connected by a reverse bend to the entrance to the next successive set in the row, characterized in that a line drawn between centers of the tubes in each set of two tube runs is skewed with respect to the central plane and the sets of the two tube runs of the adjacent rows are skewed in opposite directions.

5. A heat exchanger according to claim 4 and further including a plurality of essentially parallel spaced apart fins having slots skewed to match the skewed configuration of said tube rows.

6. A heat exchanger according to claim 5 wherein the slots of said fins have a length less than the overall outer dimension of the sets of two tubes so that the reverse bend of the tube may be inserted in the slot and the tubes are press fit against the ends of the slot.

* * * * *